US008882308B2

(12) United States Patent
Cho

(10) Patent No.: US 8,882,308 B2
(45) Date of Patent: Nov. 11, 2014

(54) RECESSED LED DOWNLIGHTING APPARATUS

(71) Applicant: Ilsung Co., Ltd., Chungcheongnam-do (KR)

(72) Inventor: Woo Hyun Cho, Seoul (KR)

(73) Assignee: Ilsung Co Ltd., Asan-si (KR)

( * ) Notice: Subject to any disclaimer, the term of this patent is extended or adjusted under 35 U.S.C. 154(b) by 70 days.

(21) Appl. No.: 13/860,014

(22) Filed: Apr. 10, 2013

(65) Prior Publication Data

US 2014/0307450 A1 Oct. 16, 2014

(51) Int. Cl.
*F21V 21/04* (2006.01)
*F21S 8/02* (2006.01)

(52) U.S. Cl.
CPC ..... *F21S 8/026* (2013.01); *F21V 21/04* (2013.01); *F21S 8/02* (2013.01)
USPC ..... 362/364

(58) Field of Classification Search
CPC ..... F21S 8/02; F21S 8/024; F21S 8/026; F21S 8/028; F21V 21/04; F21V 21/30; F21V 21/047; F21V 21/048; F21V 21/049; F21V 15/01
See application file for complete search history.

(56) References Cited

U.S. PATENT DOCUMENTS

| | | | | |
|---|---|---|---|---|
| 6,095,669 | A * | 8/2000 | Cho | 362/365 |
| 7,959,332 | B2 * | 6/2011 | Tickner et al. | 362/373 |
| 7,967,480 | B2 * | 6/2011 | Pickard et al. | 362/362 |
| 8,142,057 | B2 * | 3/2012 | Roos et al. | 362/364 |
| 8,348,477 | B2 | 1/2013 | Tickner et al. | |

* cited by examiner

*Primary Examiner* — Bao Q Truong
(74) *Attorney, Agent, or Firm* — Sughrue Mion, PLLC

(57) ABSTRACT

Disclosed is a recessed LED downlighting apparatus comprising a LED downlight fixture assembly 100, a mounting frame 300 for supporting the LED downlight fixture assembly 100 on a ceiling panel 1, an electric junction box 400 mounted on the mounting frame 300, at least one electric wire 210 for electrically connecting the LED drive 170 and the junction box 400, including a first electric wire element 210A extended from the LED drive 170 and a second electric wire element 210B extended from the junction box 170, an electric connector 230 for electrically connecting the first electric wire element 210A and the second electric wire element 210B, a flexible metal conduit 220 including for sheltering the electric wire 210, a first conduit element 220A for sheltering the first electric wire element 210A and a second conduit element 220B for sheltering the second electric wire element 210B, the first conduit element 220A being secured at one end to the plate of the heat sink 120 with a clip element, and the second conduit element 220B secured at one end to the junction box 400 and a connector cover 500 for connecting the first conduit element 210A and the second conduit element 210B and sheltering the electric connector 230.

7 Claims, 6 Drawing Sheets

RECESSED LED DOWNLIGHTING APPARATUS

TECHNICAL FIELD

The present invention relates to a recessed LED downlighting apparatus, and more particularly, to improvement of installation of a recessed LED downlighting apparatus in a ceiling for simple and quick installation thereof.

BACKGROUND OF THE INVENTION

Recessed LED downlight fixtures are typically installed above a ceiling. This limits the accessibility to the user. Further, it requires cost and time consuming to repair or replace components such as light fixture assembly and other components that are mounted to the lighting assembly. Typically, replacement or modifications to an installed lighting assembly require removal of the existing assembly or various components from the ceiling.

An example of conventional recessed downlight fixture is disclosed in U.S. Pat. No. 8,348,477 by Cooper Technologies Company, which includes a downlight fixture installed in a opening a ceiling panel, a junction box mounted on the ceiling panel, and electric wires electrically connecting the LED downlight fixture with the junction box to supply electrical power to a LED driver of the LED downlight fixture. The electric wires extend from the junction box to the LED driver. A flexible metal conduit covers the electric wires to protect them.

For the conventional downlighting system, the downlight fixture is mounted on a pair of hanger bars spaced between each other, or a flat mounting plate over the ceiling panel, and then wiring between the downlight fixture assembly and the junction box are made over the ceiling panel. That is, the wiring should be made at every terminal near the ceiling. Additionally, the outer reflector is screwed to fix it on the hanger. These make quick installation of the downlight fixture to be difficult and thus increase costs for installation or replacement into new downlight fixtures.

SUMMARY OF THE INVENTION

An object of the present invention is to provide a recessed LED downlighting apparatus capable being retrofitted in a ceiling or replaced without removal of the components from the ceiling.

To accomplish the object, the present invention comprises an outer reflector, a LED module having at least one LED package and surrounded by the outer reflector, a heat sink attached to a top surface of the LED module to dissipating heat from the LED package, an inner reflector for the LED module, and a LED drive;

a mounting frame for supporting the outer reflector of the LED downlight fixture assembly on a ceiling panel;

an electric junction box mounted on the mounting frame; at least one electric wire for electrically connecting the LED drive and the junction box, the electric wire including a first electric wire element extended from the LED drive and a second electric wire element extended from the junction box;

an electric connector for electrically connecting the first electric wire element and the second electric wire element, the electric connector having a socket connector at the end of the first electric wire element and a plug connector on the end of the second electric wire element and coupled with the socket connector;

a flexible metal conduit for sheltering the electric wire and having spiral grooves on the outer surface, the conduit including a first conduit element for sheltering the first electric wire element and a second conduit element for sheltering the second electric wire element, the first conduit element being secured at one end to the plate of the heat sink with a clip element, and the second conduit element secured at one end to the junction box; and a connector cover for connecting the first conduit element and the second conduit element and sheltering the electric connector.

Further, the conduit connector of the present invention includes a lower half cover and an upper half cover hinged at one end to the lower half cover. The lower half cover retains the end of the first conduit element with a spring clip element, and the upper half cover retains the end of the second conduit element with a clip element.

Furthermore, the lower half cover includes a front wall having an aperture, and the upper half cover includes a top wall having a retention spring fit in the aperture of the front wall of the lower half cover for locking.

The mounting frame includes an upper rim defining an aperture and being supported on the upper edge of the opening, a circular collar downwardly extending from the upper rim, and mounting bracket horizontally extending from the upper rim and supported on the top surface of the ceiling panel to secure the junction box thereon.

The circular collar includes a plurality of spring clips inwardly extended therefrom to tightly press on and hold the outer surface of the outer reflector fit in the opening.

The inner reflector is attached to the bottom wall of the heat sink in a twist-and-lock fashion. The heat sink includes at least two of opposed mounting bolts, each of which has a head under the bottom wall and is biased upwardly by a spring loaded between a nut and the bottom wall. The inner reflector includes key ways for receiving the head of the mounting bolt therethrough, and locking slots of width smaller that the diameter of the head.

BRIEF DESCRIPTION OF THE DRAWINGS

These and other features, aspects, and advantages of the present invention will become better understood with reference to the following description, appended claims, and accompanying drawings:

DETAILED DESCRIPTION OF THE INVENTION

Hereinafter, a preferred embodiment of the present invention will now be described in detail with reference to the accompanying drawings.

Figure 1:
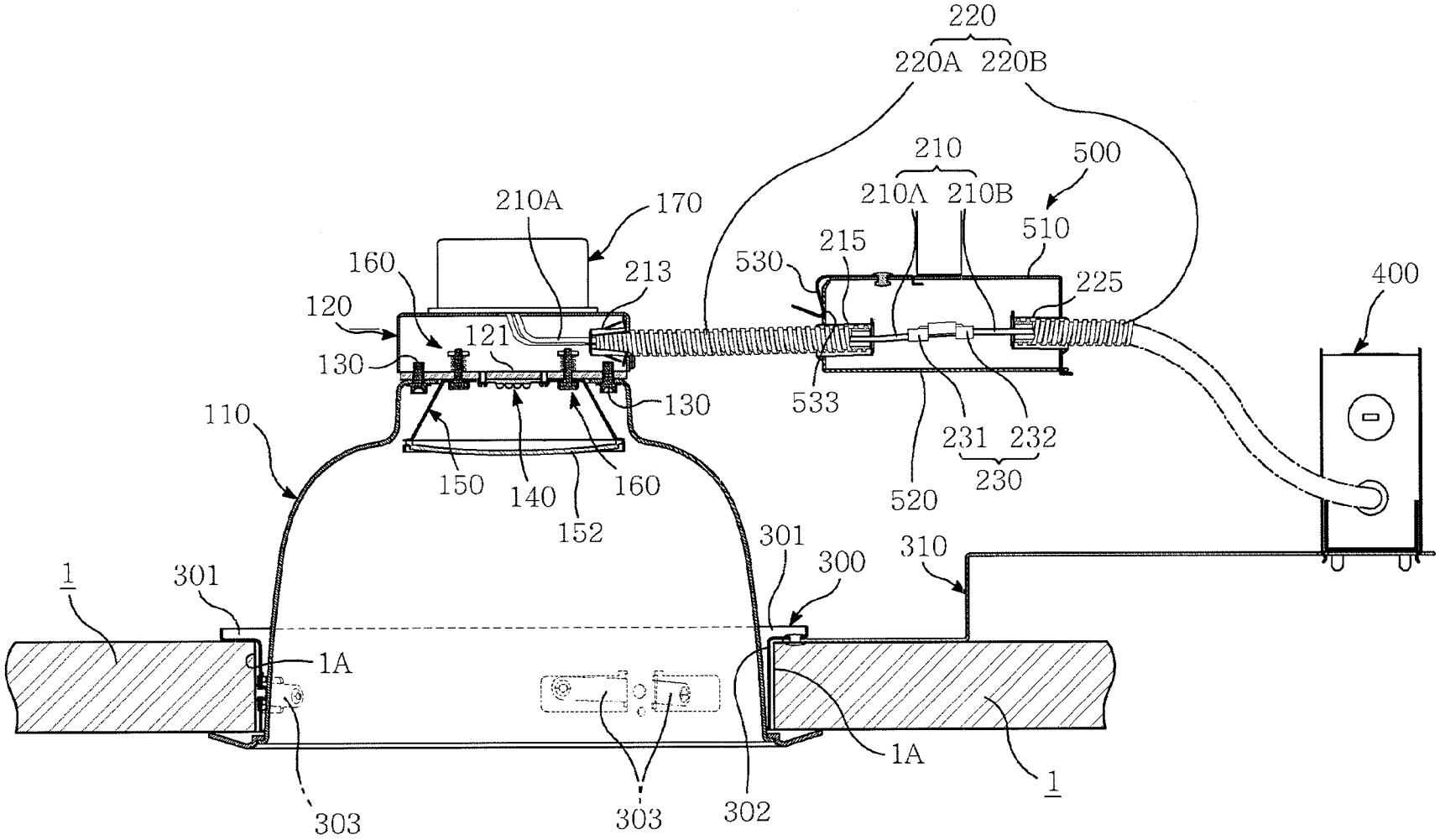
FIG. 1 shows a schematic view illustrating a recessed LED downlighting apparatus installed in a ceiling according to the present invention.
Figure 2:
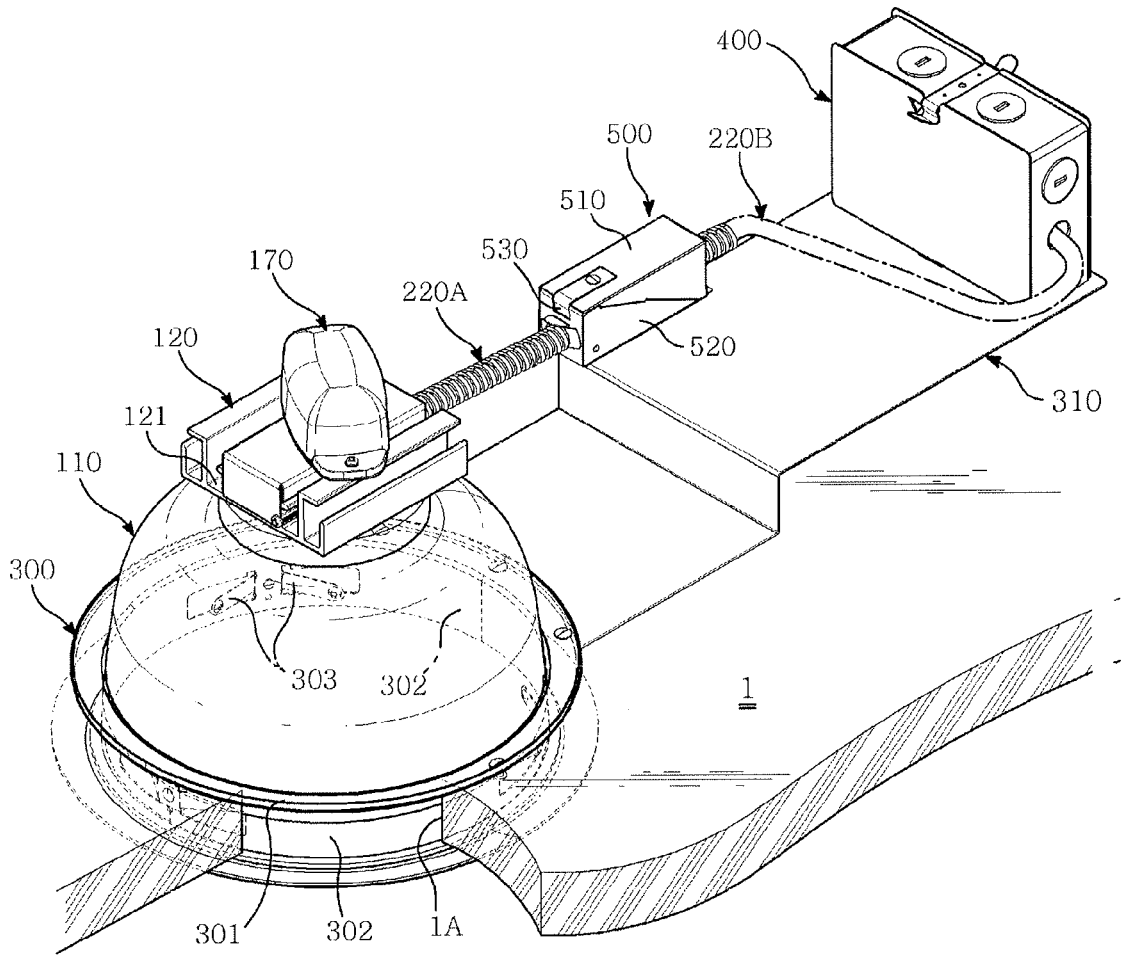
FIG. 2 shows a partial cut-away perspective view illustrating a recessed LED downlighting apparatus installed in a ceiling according to the present invention.

Referring to FIGS. 1 and 2, a recessed LED downlighting apparatus according to an embodiment of the present invention comprises a LED downlight fixture assembly 100, which includes an outer reflector 110, a LED module 140 having at least one LED package and surrounded by the outer reflector 110, a heat sink 120 attached to a top surface of the LED module 140 to dissipating heat from the LED package, an inner reflector 150 for the LED module 140, and a LED drive 170.

On a ceiling panel 1, as shown in FIGS. 1 and 2, there is mounted a mounting frame 300 for installing the LED downlight fixture assembly 100 in an opening 1A of a ceiling panel 1. The mounting frame 300 includes an upper rim 301 defining an aperture and being supported on the upper edge of the opening 1A, a circular collar 302 downwardly extending from the upper rim 301, and mounting bracket 310 horizontally extending from the upper rim 301 and supported on the top surface of the ceiling panel 1 to secure the junction box 400 thereon.

The collar 302 defines an opening for receiving the outer reflector 110 of the LED light fixture assembly 100 and includes a plurality of spring clips 303 inwardly extended therefrom to tightly press on and hold the outer surface of the outer reflector 110 fit in the opening. When the LED light fixture assembly 100 is installed in the ceiling, the installation of the LED light fixture assembly 100 is completed only by fitting it into the opening of the collar 302 under the ceiling panel 1.

Figure 3A:
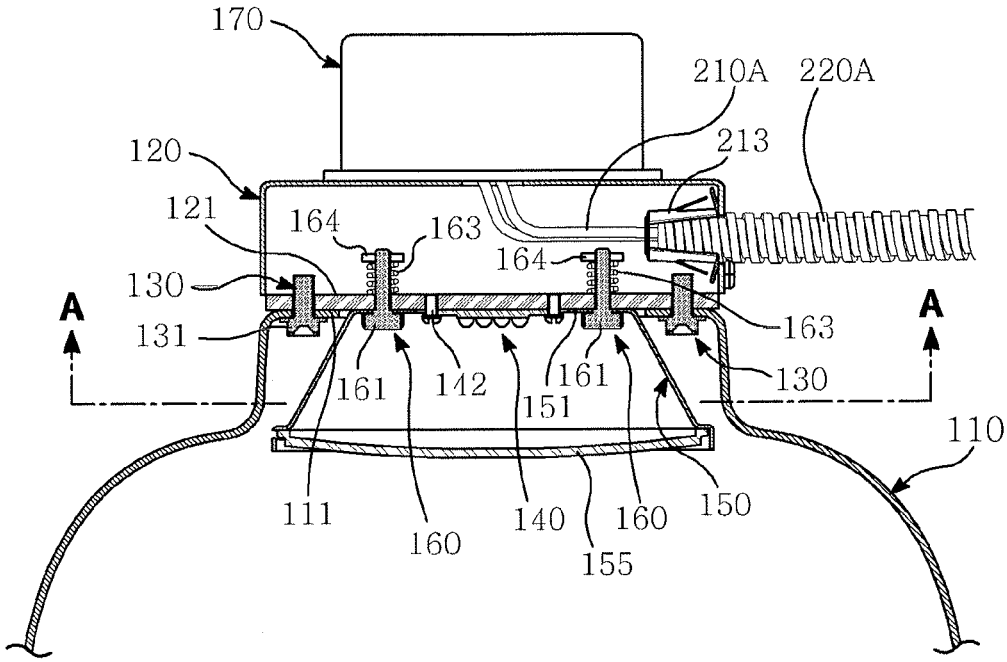
FIG. 3A shows a partially cross-sectional view illustrating that an outer reflector and an inner reflector are mounted on a heat sink of the LED downlight fixture according to an embodiment of the present invention.
Figure 3B:
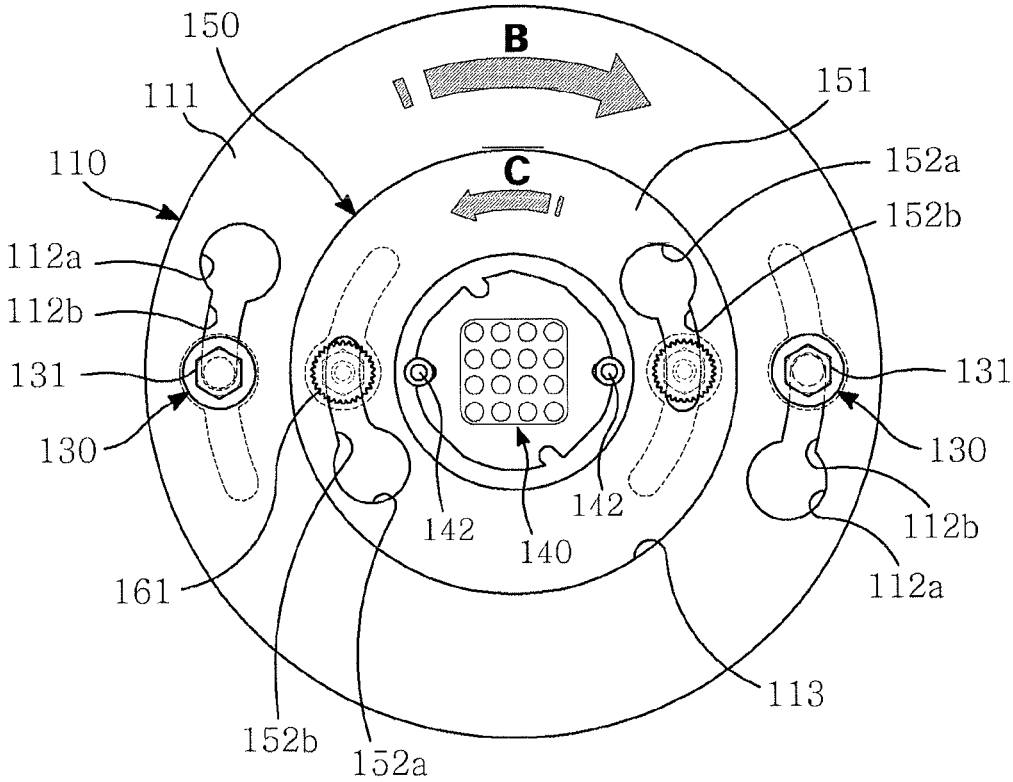
FIG. 3B shows a bottom view taken line A-A in FIG. 3A.
Figure 4:
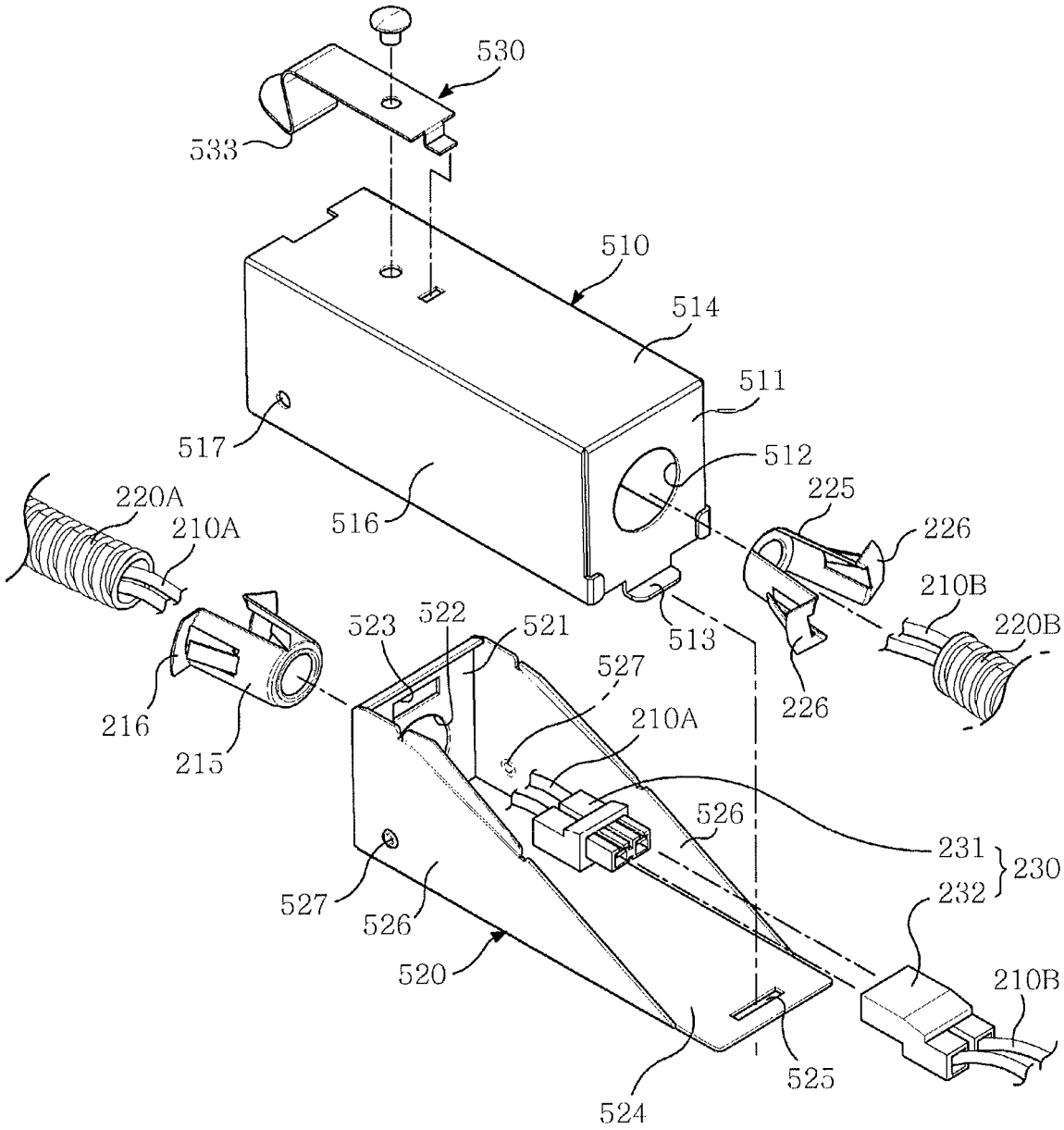
FIG. 4 shows an exploded view of a connector cover according to an embodiment of the present invention.

As shown in FIGS. 3A and 3B, the outer reflector 110 and the inner reflector 150 are concentrically positioned and attached to the bottom wall 121 of the heat sink 120 in a 'twist-and-lock' fashion.

On the bottom wall 121 of the heat sink 120, two of opposed head bolts 130 are screwed. The outer reflector 110 includes an annular top wall 111 at the top end and defining an opening 113 in which the LED module 140 is located. The annular top wall 111 includes key ways 112*a* for receiving the head 131 of bolt 130 therethrough and locking slots 112*b* continuously connected to the key ways 112*a*. The locking slot 112*b* is of width smaller than a diameter of the bolt head 131.

The key ways 112*a* receives the head 131 of bolt 130 from below and by rotating the outer reflector 110 in a clockwise direction (in the direction of arrow B shown in FIG. 3B) so that the bolts 130 move into the locking slots 112*b* and the outer reflector 110 is locked on the heat sink 120. Accordingly, the outer reflector 110 can be simply attached to the bottom of the heat sink 120 in a twist-and-lock fashion.

Likewise, the inner reflector 150 concentrically positioned in the outer reflector 110 is attached to the bottom of the heat sink 120 in a twist-and-lock fashion. At least two of opposed mounting bolts 160 penetrate the bottom wall 121 of the heat sink 120, and is biased upwardly by a spring 163 loaded between a nut 164 and the bottom wall 121 of the heat sink 120. The inner reflector 150 includes an annular wall 151 at the top end. The annular wall 151 includes key ways 152*a* for receiving the head 161 of the mounting bolt 160 therethrough and locking slots 152*b* continuously connected to the key ways 152*a*. The locking slot 152*b* is of width smaller than a diameter of the head 161.

The key ways 152*a* receives the head 161 of the mounting bolt 160 from below and by rotating the inner reflector 150 in a counterclockwise direction (in the direction of arrow C shown in FIG. 3B) so that the mounting bolts 160 move into the locking slots 152*b* and the inner reflector 150 is rendered to be locked on the bottom of the heat sink 120. When rotating the inner reflector 150 in the opposite direction (in a clockwise direction), the inner reflector 150 is unlocked. By the twist-and-lock structure, the outer reflector 110 and the inner reflector 150 can be easily and simply assembled and disassembled for maintenance.

The LED drive 170 and the junction box 400 are electrically connected by electric wire 210 for supplying electric power to the LED drive 170 via the junction box 400. The electric wire 210 is divided into a first electric wire element 210A and a second electric wire element 210B. The first electric wire element 210A is electrically connected to the LED drive 170, and the second electric wire element 210B is extended from the electric junction box 400. The first electric wire element and the second wire element are connected to each other with an electric connector 230. The electric connector 230 includes a socket connector 231 provided at the end of the first electric wire element 210A and a plug connector 232 at the end of the second electric wire element 210B being coupled with the socket connector 231.

The electric wire 210 is inserted in a flexible metal conduit 220 to be sheltered and protected. The conduit 220 includes a first conduit element 220A for sheltering and protecting the first electric wire element 210A and a second conduit element 220B for sheltering and protecting the second electric wire element 210B. The first conduit element 220A is anchored at one end to the heat sink 120 with a clip element 211, and the second conduit element 220B is secured at rear end to the junction box 400 with a clip element (not shown).

As shown in FIGS. 1 to 3, a connector cover 500 shelters the electric connector 230 and also connects ends of the two electric conduit elements 220A and 220B. The connector cover 500 includes an upper half cover 510 and a lower half cover 520, which are coupled to each other.

The lower half cover 520 includes a front wall 521 having a hole 522 for receiving the end of the first conduit element 220A therethrough and an aperture 523, side walls 526 apart from each other in a predetermined distance and having a protrusion 527 at the front end, and a bottom wall 524 having a slot 525. The end of the first conduit element 220A is inserted into the lower half cover 520 through the hole 522 of the front wall 521 and retained to the front wall 521 with a flange 216 of a clip member 215.

The upper half cover 510 includes a rear wall 511 having a hole 512 for receiving the end of the second conduit element 220B therethrough, a top wall 514 having a retention spring 530 revetted thereon, and two side walls 516 having a hole 517 mated with the protrusion 527 of the lower half cover 520. The end of the second conduit element 220B is inserted into the upper half cover 510 through the hole 512 and retained to the rear wall 511 with a flange a clip member 225.

The clip members 215 and 225 are put on the end of the conduit elements 220A and 220B in the connector cover 500, and the flange 216 and 226 contacts to the outer surfaces of the wall 521 and 511 to retain the conduit elements 220A and 220B against the connector cover 500.

A slot 525 is formed on the rear end of the bottom 524 of the lower half cover 520, and a hook 513 is provided on the upper half cover 510. The upper half cover 510 is hinged to the lower half cover 520 by engaging the hook 533 of the upper half cover 510 in the slot 525 of the lower half cover 520.

The lower half cover 520 has a protrusion 527 at the end of the side walls 526, and the upper half cover 510 has a hole 517 formed at the end of side walls 516. When the upper half cover 510 completely covers the lower half cover 520 and thus the protrusion 527 fits in the hole 517. The upper half cover 510 is retained to the lower half cover 520 at a close position. The lower half cover 520 has an aperture 523 on the front wall 521, and the upper half cover 510 has a retention spring 530 revetted on top wall 514 and having a tip 533 to be fitted in the aperture of the lower half cover 520.

Accordingly, when the weight of the fixture assembly 100 causes a tension force to act on the conduit 220, the connector cover 520 bears the tension force so that it may not act on the electric connector 230 through the electric wire 210.

Hereafter, installation of the LED downlighting apparatus in a ceiling is described in detailed with reference to FIGS. 5A to 5C.

Figure 5A:
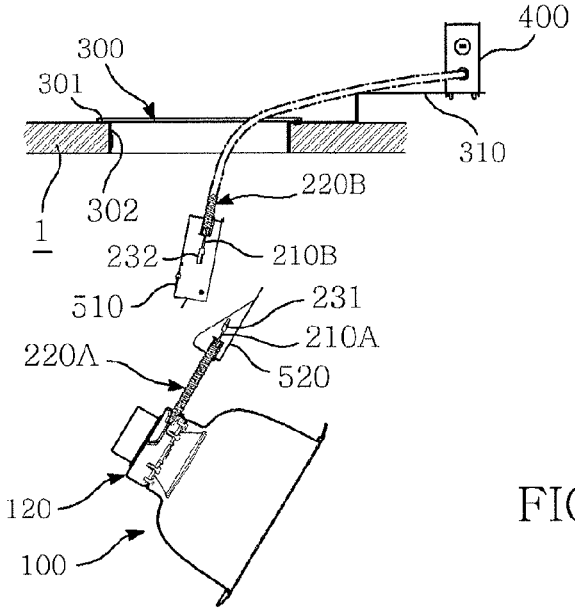
FIGS. 5A to 5C show steps of installing the recessed LED downlighting apparatus in a ceiling according to the present invention.

As shown in FIG. 5A, the mounting frame 300 is mounted in a ceiling and the electric junction box 400 is secured to the mounting bracket 310. The second conduit element 220B covering the second electric wire element extended from the junction box 400 is pulled out under the ceiling panel 1 through the opening defined by the rim 302. The LED downlight fixture assembly 100 is completed under the ceiling. The first conduit element 220A covering the first electric wire element 210A is extended from the heat sink 120 fixed to the outer reflector 110.

The upper half cover 510 is coupled to the end of the second conduit element 220B, and the lower half cover 520 is coupled to the end of the first conduit element 220A.

Figure 5B:
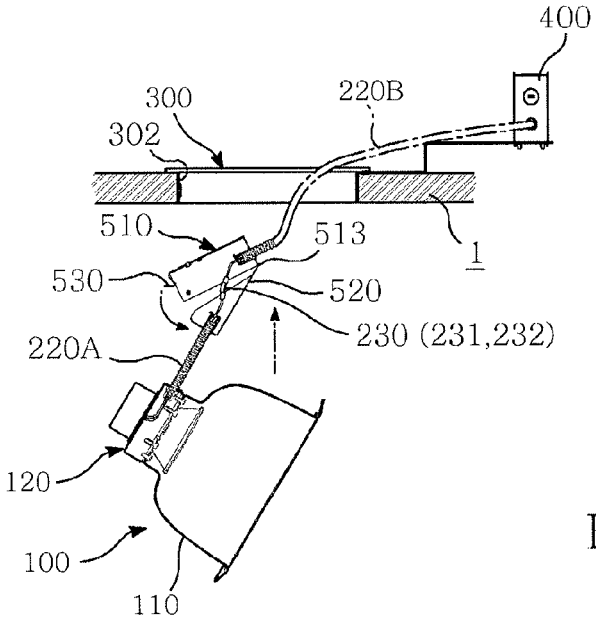
Figure 6:
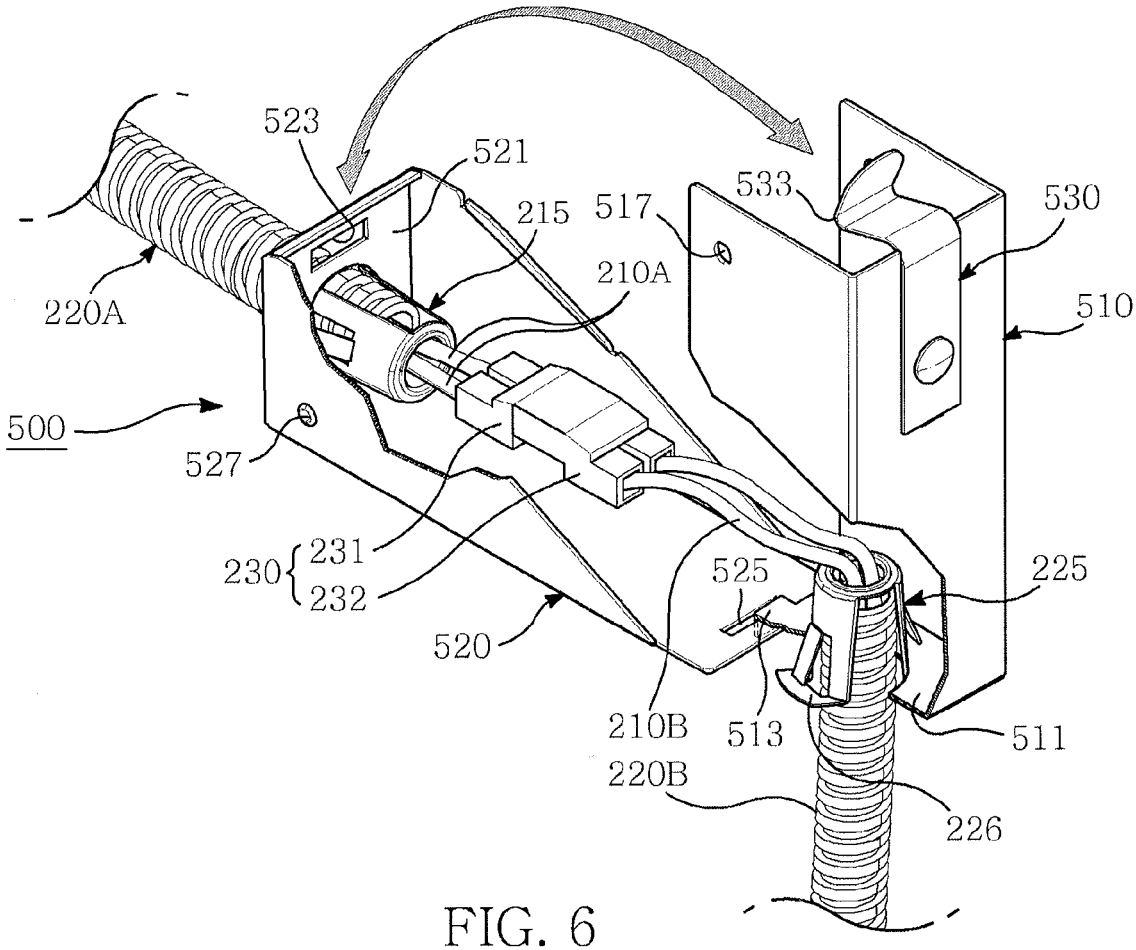
FIG. 6 shows a partially broken perspective view of the connector cover according to the present invention.

As shown in FIGS. 5B and 6, the lower half cover 520 is coupled to the upper half cover 510 to connect two conduit elements 220A and 220B and shelter the electric connector 230.

Figure 5C:
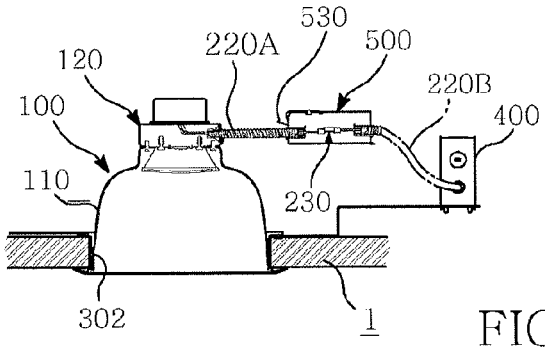

As shown in FIG. 5C, the LED downlight fixture assembly 100 together with the conduit elements 220A and 220B are pushed back into the opening in the ceiling panel 1. The outer reflector 110 of the downlight fixture assembly 100 is held by a plurality of the spring clips 303 in a recessed state.

What is claimed is:

1. A recessed LED downlighting apparatus, comprising:

a LED downlight fixture assembly 100 including an outer reflector 110, a LED module 140 having at least one LED package and surrounded by the outer reflector 110, a heat sink 120 attached to a top surface of the LED module 140 to dissipating heat from the LED package, an inner reflector 150 for the LED module 140, and a LED drive 170;

a mounting frame 300 for supporting the outer reflector 110 of the LED downlight fixture assembly 100 on a ceiling panel 1;

an electric junction box 400 mounted on the mounting frame 300;

at least one electric wire 210 for electrically connecting the LED drive 170 and the junction box 400, the electric wire 210 including a first electric wire element 210A outwardly extended from the LED drive 170 and a second electric wire element 210B outwardly extended from the junction box 170;

an electric connector 230 for electrically connecting the first electric wire element 210A and the second electric wire element 210B, the electric connector having a socket connector 231 at the end of the first electric wire element 210A and a plug connector 232 on the end of the second electric wire element 210B and coupled with the socket connector 231;

a flexible metal conduit 220 for sheltering the electric wire 210 and having spiral grooves on the outer surface, the conduit 220 including a first conduit element 220A for sheltering the first electric wire element 210A and a second conduit element 220B for sheltering the second electric wire element 210B, the first conduit element 220A being secured at one end to the plate of the heat sink 120 with a clip element, and the second conduit element 220B secured at one end to the junction box 400; and a connector cover 500 for connecting the first conduit element 220A and the second conduit element 220B and sheltering the electric connector 230.

2. The recessed LED downlighting apparatus of claim 1, wherein the conduit connector 500 includes a lower half cover 520 and an upper half cover 510 hinged at one end to the lower half cover 520, the lower half cover 520 retaining the end of the first conduit element 220A with a spring clip element 215, and the upper half cover 510 retaining the end of the second conduit element 220B with a clip element 225.

3. The recessed LED downlighting apparatus of claim 2, wherein the lower half cover 520 includes a front wall 521 having an aperture 523, and the upper half cover 510 including a top wall 514 having a retention spring 530 fit in the aperture 523 of the front wall 521 of the lower half cover 520 for locking.

4. The recessed LED downlighting apparatus according to claim 1, wherein the mounting frame 300 includes an upper rim 301 defining an aperture and being supported on the upper edge of the opening 1A, a circular collar 302 downwardly extending from the upper rim 301, and mounting bracket 310 horizontally outwardly extending from the upper rim 301 to secure the junction box 400 thereon.

5. The recessed LED downlighting apparatus according to claim 4, wherein the circular collar 302 includes a plurality of spring clips 303 inwardly extended therefrom to tightly press on and hold the outer surface of the outer reflector 110 fit in the opening.

6. The recessed LED downlighting apparatus according to claim 1, wherein the inner reflector 150 is attached to the bottom wall 121 of the heat sink 120 in a twist-and-lock fashion.

7. The recessed LED downlighting apparatus according to claim 6, wherein the heat sink 120 includes at least two of opposed mounting bolts 160, each of mounting bolts 160 having a head 161 under the bottom wall 121 and being biased upwardly by a spring 163 loaded between a nut 164 and the bottom wall 121, and wherein the inner reflector 150 includes key ways 152*a* for receiving the head 161 of the mounting bolt 160 therethrough, and locking slots 152*b* of width smaller that the diameter of the head 161.

* * * * *